United States Patent [19]

Gohara

[11] Patent Number: 4,949,684

[45] Date of Patent: Aug. 21, 1990

[54] STARTING SYSTEM FOR INTERNAL COMBUSTION ENGINE

[75] Inventor: Yoshihiro Gohara, Hamamatsu, Japan

[73] Assignee: Sanshin Kogyo Kabushiki Kaisha, Hamamatsu, Japan

[21] Appl. No.: 313,542

[22] Filed: Feb. 21, 1989

[30] Foreign Application Priority Data

Feb. 25, 1988 [JP] Japan ..... 63-42885

[51] Int. Cl.[5] ..... F02N 11/10

[52] U.S. Cl. ..... 123/179 BG; 123/198 DC; 123/630; 440/85

[58] Field of Search ..... 123/179 BG, 198 DC, 123/630, 179 B; 440/85

[56] References Cited

U.S. PATENT DOCUMENTS

| | | | |
|---|---|---|---|
| 4,369,745 | 1/1983 | Howard | 123/198 DC |
| 4,534,326 | 8/1985 | Bowcott | 123/198 DC |
| 4,553,511 | 11/1985 | Hayakawa et al. | 123/179 B |

*Primary Examiner*—Andrew M. Dolinar

*Attorney, Agent, or Firm*—Ernest A. Beutler

[57] ABSTRACT

Two embodiments of starting systems for internal combustion engines that prevent backfiring by precluding starting when the kill switch is energized. In one embodiment, the kill switch includes two pair of contacts, one for the kill circuit and one for the starting circuit, with the starting circuit contacts being normally closed and the kill circuit contacts being normally open. In the other embodiment, energization of the kill circuit also energizes a relay that opens the starting circuit.

9 Claims, 4 Drawing Sheets

*Figure 3*
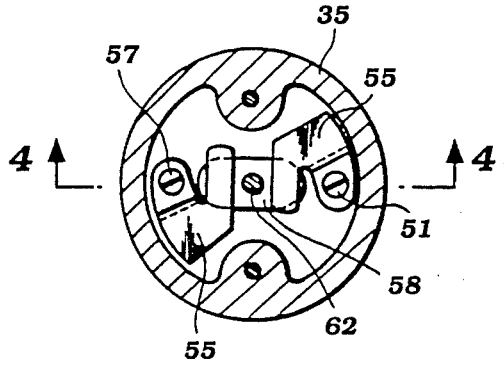
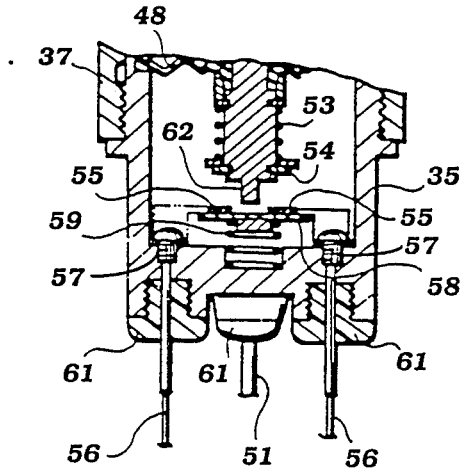
*Figure 4*

STARTING SYSTEM FOR INTERNAL COMBUSTION ENGINE

BACKGROUND OF THE INVENTION

This invention relates to a starting system for an internal combustion engine and more particularly to a system that prevents operation of the starter after the engine has been stopped so as to preclude the likelihood of backfiring.

In many forms of engine controls, there is provided a kill circuit for interrupting the firing of the spark plugs to stop the engine. This type of arrangement is frequently incorporated in magneto equipped engines since there is not a normal ignition switch as with conventional battery powered ignition systems. Frequently, the kill switch is coupled to some form of safety device so as to automatically stop the engine in the event of a dangerous condition, such as if the rider of a watercraft powered by the engine falls overboard. Although these devices are particularly advantageous, under some circumstances certain problems can arise.

For example, if the engine is killed and an attempt is made to restart the engine shortly after, the residual combustible mixture in the exhaust system may cause a condition known as backfiring. Backfiring can damage the engine and its exhaust system.

It is, therefore, a principal object of this invention to provide an improved arrangement for preventing such a condition upon the starting of an engine.

It is a further object of this invention to provide an improved starting system for an internal combustion engine wherein the engine cannot be restarted until immediately after the engine has stopped.

It is a further object of this invention to provide an arrangement wherein restarting of the engine after it has been stopped by the kill switch is retarded.

SUMMARY OF THE INVENTION

This invention is adapted to be embodied in a control system for a spark ignited internal combustion engine having a kill circuit for interrupting the firing of the spark plug and a starter for starting the engine. In accordance with the invention, means preclude operation of the starter when the kill circuit is energized.

BRIEF DESCRIPTION OF THE DRAWINGS

FIG. 3 is a cross-sectional view taken along the line 3—3 of FIG. 2.

FIG. 4 is a cross-sectional view taken along the line 4—4 of FIG. 3.

DETAILED DESCRIPTION OF THE PREFERRED EMBODIMENTS

Figure 1:
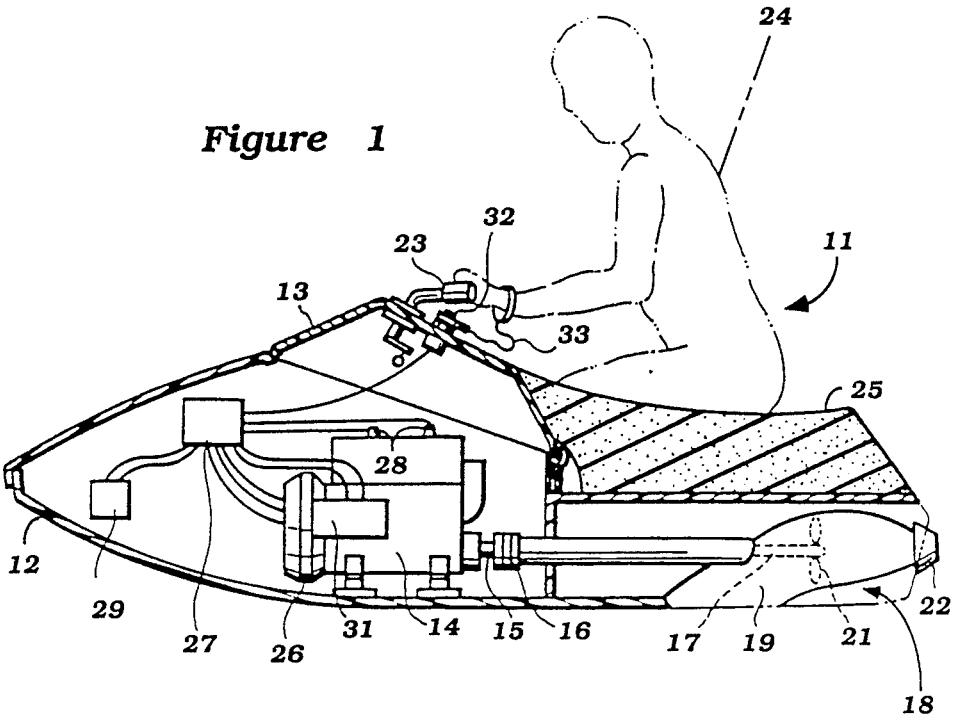
FIG. 1 is a side elevational view of a small watercraft constructed in accordance with an embodiment of the invention, with a portion broken away.

Referring first to FIG. 1, a small watercraft constructed in accordance with an embodiment of the invention is identified generally by the reference numeral 11. Although the invention is described in conjunction with a small watercraft, where it has particular utility, it is to be understood that certain facets of the invention may be utilized in other applications. The invention, however, has particular utility in connection with small watercraft because these devices normally employ a kill switch and a safety device for operating the kill switch in the event the rider becomes displaced from the watercraft.

The watercraft 11 is comprised of a hull 12 that defines an engine compartment which is accessible by means of a removable hatch 13. A spark ignited internal combustion engine 14 is contained within this engine compartment and has its output shaft 15 coupled by means of a coupling 16 to an impeller shaft 17 of a jet propulsion unit, indicated generally by the reference numeral 18. The jet propulsion unit 18 includes a water passageway 19 and an impeller 21 that is connected to the impeller shaft 17 for drawing water through an inlet and discharging it through an adjustable steering nozzle 22 for powering and steering the watercraft 11 in a known manner.

The steering of the nozzle 22 is controlled by means of a handlebar assembly 23 that is mounted on the hatch cover 13 in a position to be steered by a rider 24, shown in phantom and seated upon a seat 25. In the illustrated embodiment, the watercraft 11 is of the type that is designed to be ridden primarily by a single rider sitting on the seat 25 in straddle fashion.

As has been noted, the engine 14 is of the spark ignited type and the ignition system includes a combined flywheel magneto generator 26 that outputs its charge to a spark control circuit 27 which, in turn, fires the spark plugs 28 of the engine 14 in a manner to be described. The magneto generator 26 also charges a battery 29 and is electrically started by means of a starter motor 31 which drives a starter gear that is associated with the flywheel magneto 26 in a known manner.

There is also provided in ready access to the rider 24 a kill switch 32 by which the rider may stop the running of the engine 14. In addition, a safety device 33 is coupled to the kill switch 32 for stopping the engine 14 by energizing the kill switch 32 if the rider 24 inadvertently falls overboard.

Figure 5:
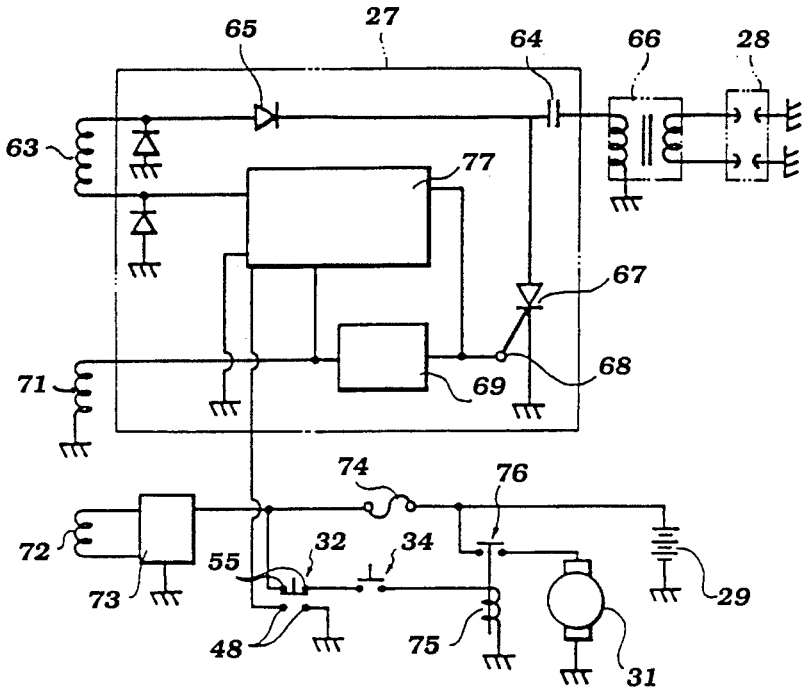
FIG. 5 is a schematic electrical diagram of this embodiment of the invention.

The starter motor 31 is energized by means of a starter switch which does not appear in FIG. 1 but which is shown in FIG. 5 and is indicated by the reference numeral 34. The manner in which the starter motor 31 is energized and its interconnection with the switch 32 will be described in conjunction with the description of this figure.

Figure 2:
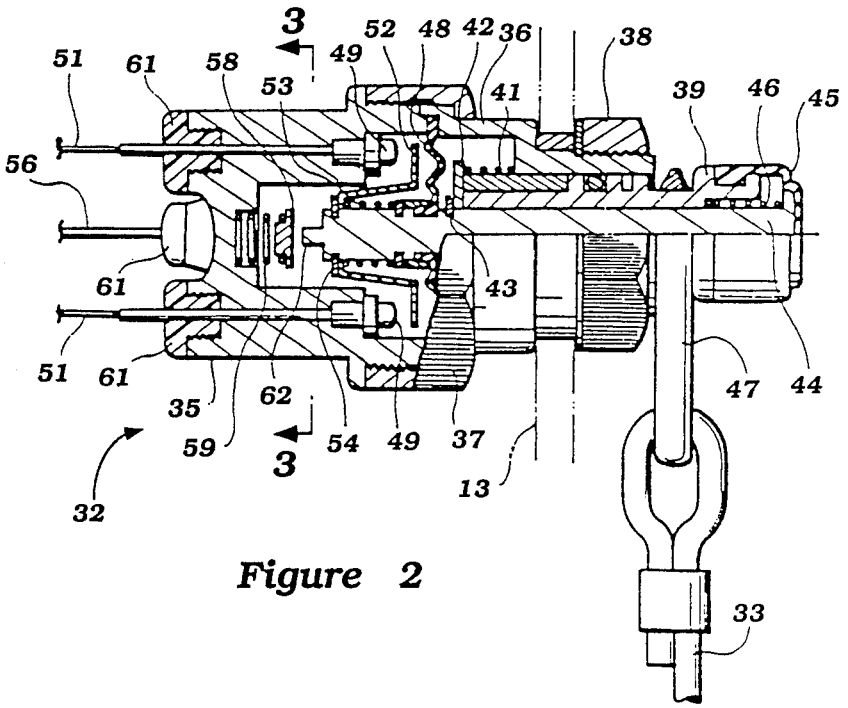
FIG. 2 is an enlarged cross-sectional view showing a kill switch constructed in accordance with an embodiment of the invention.

Referring now in detail to FIGS. 2 through 4, the construction and operation of the switch 32 will be described. The switch 32 is comprised of an outer housing that consists of a first piece 35 and a second piece 36 that are secured together by a nut like fastener 37. The portion 36 has a cylindrical part that extends through an opening in the cowling 13 and the switch assembly 32 is held to the cowling by means of a nut 38 that is threaded onto this portion.

A first plunger portion 39 is slidably supported within the housing part 36 and is normally urged in the left hand direction as viewed in FIG. 2 by means of a coil compression spring 41 that engages the housing part 36 and a washer 42 that is held in place axially by means of an E ring 43 that is affixed to a second plunger 44 that is slidably supported within the plunger 39. The plunger 44 has a headed portion which is covered by an elastic seal 45 but which nevertheless permits it to be slid axially relative to the plunger portion 39, for a reason to be described. A coil compression spring 46 normally holds the E ring 43 against the washer 42 in the position shown in FIG. 2.

A key like member 47 of the safety device 33 is normally interposed between the head of the plunger 39 and the housing portion 36 and nut 38 so as to hold the switch 32 in the condition shown in FIG. 2.

A diaphragm type gasket 48 is affixed to the inner plunger 44 and is sealingly engaged between the housing pieces 35 and 36 so as to provide a seal for the electrical portion of the assembly, as will now be described. This electrical portion includes a normally opened kill switch that is comprised of a pair of terminals 49 that are affixed within the housing piece 35 and which have leads 51 that are connected in the circuit of FIG. 5 in a manner which will be described. A wiper 52 is held relative to the inner plunger 44 by means of a coil compression spring 53 that encircles the plunger 44 and urges the wiper 52 toward engagement with a snap ring 54 that is affixed to the lower plunger end.

When the construction is in the position shown in FIG. 2, it should be clear that the kill switch comprised of the terminals 49 and the wiper 52 are in their opened position. The kill switch can be closed by either depressing the inner plunger 44 so as to effect movement of it to the left relative to the outer plunger portion 39. For this purpose, a force is applied to the diaphragm 45 and the plunger 44 will move to the left until the wiper 52 engages the terminals 49 and completes the grounding circuit, as will be described. It should be noted that the sliding support of the wiper 52 on the plunger 44 permits some degree of lost motion, for a reason to be described.

In the event the safety key 47 is pulled out of the switch assembly by the rider 24 falling overboard, the coil spring 41 will then move the outer plunger 39 and inner plunger 44 together so as to cause the wiper 52 to engage the terminals 49 and close the kill switch and stop the engine in a manner to be described.

In addition to the kill switch assembly just described, the switch 32 also includes a normally closed starter enabling circuit switch. This switch is comprised of a pair of terminals 55 that are connected to leads 56 by means of screws 57 that are threaded into the base of the housing piece 35. A wiper contact 58 is normally urged into contact with the terminals 55 by means of a coil compression spring 59 so as to keep the switch in the described normally closed condition. It should be noted that insulating grommets 61 insulate each of the leads 51 and 56 and also provide a watertight insulation for the assembly.

The inner plunger portion 44 has a projecting part 62 that is adapted to engage the wiper 58 when the inner plunger 44 is depressed or when the outer plunger 39 and inner plunger 44 move together due to removal of the key 47. When the plunger portion 62 engages the wiper terminal 58, its contact with the terminals 55 will be interrupted and this switch will be opened. The construction is such that this switch is normally opened before the kill switch is closed and the sliding support of the wiper 52 on the inner plunger 44 will permit such relative movement.

Referring now to FIG. 5, the ignition system for firing the spark plugs 28 includes a charging coil 63 of the magneto generator 26 which charges a charging capacitor 64 of the spark control device 27 through a diode 65. The charging coil 64 is in circuit with the primary winding of a spark coil 66. The secondary winding of the spark coil 66 is in circuit with the spark plugs 28.

As is well known with this type of circuit, the charging capacitor 64 is charged from the charging coil 63 during the rotation of the engine crankshaft. At the appropriate interval, the charging capacitor 64 is discharged so as to generate a voltage for firing the spark plugs 28. An SCR 67 is in circuit with the charging capacitor 64 and the ground and has its base 68 controlled by a spark control circuit 69. The spark control circuit 69 receives an input signal from a pulser coil 71 so as to change the state of the base 68 to render the SCR 67 conductive at the appropriate crank angle and fire the spark plugs 28 in a known manner.

The magneto generator 26 also includes a further charging coil 72 that charges the battery 29 through a rectifier circuit 73 and protective fuse 74. The starter switch 34 is in this circuit and when closed energizes a starter relay 75 to close the relay switch 76 and complete the circuit through the starter motor 31 to effect starting of the engine. It should be noted that the circuit to the starter relay 75 includes the normally closed contacts 55 of the kill switch assembly 32.

The kill switch terminals 48 when contacted by the wiper 52 will effect energization of a misfiring circuit 77 that will control the gate 68 of the SCR 67 and misfire the spark plugs 28 so as to stop the engine.

It should be noted that when the kill switch 32 is energized so as to bring the wiper 52 into contact with the terminals 48, the circuit between the wiper 58 and the terminals 55 will be opened. At this time, closure of the starter switch 34 will be ineffective to energize the starter solenoid 75 since the circuit is now open as clearly shown in FIG. 5. As a result, the operator cannot attempt to restart the engine so long as the kill switch 32 is open and hence, backfiring will be precluded.

Figure 6:
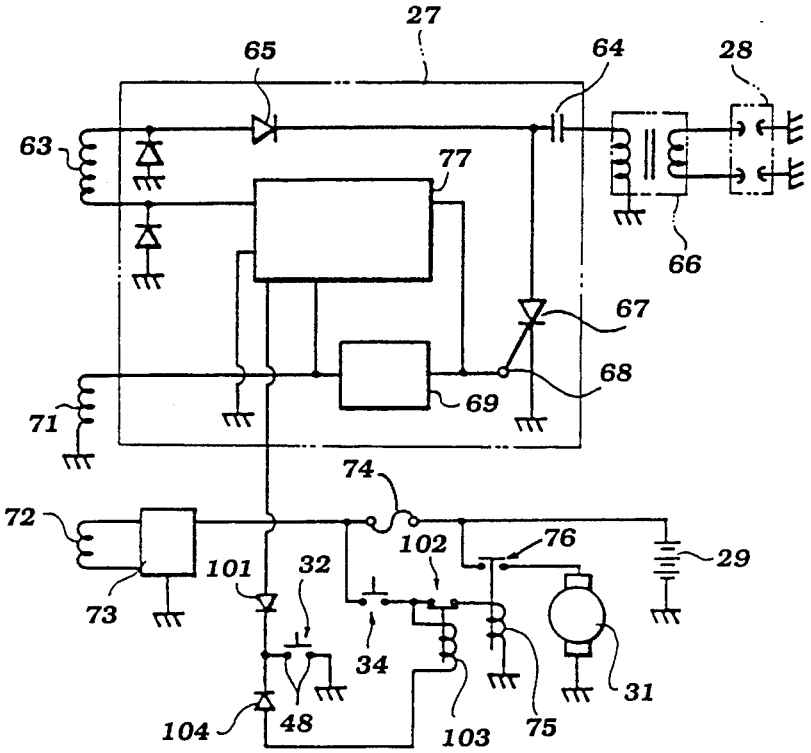
FIG. 6 is a schematic electrical diagram, in part similar to FIG. 5, showing another embodiment of the invention.

FIG. 6 shows another embodiment of the invention which is generally similar to the embodiment of FIG. 5 and due to the similarity of these two embodiments, components of the circuits which are the same and which function in substantially the same manner have been identified by the same reference numerals and will be described again only insofar as is necessary to understand the construction and operation of this embodiment.

In this embodiment, the switch of the construction shown in FIGS. 2 through 4 need not have the second pair of terminals in the starter circuit since a single pair of terminals, those associated with the kill switch, will suffice. As may be seen in FIG. 6, the kill switch terminals 48 are connected to ground and to the misfiring circuit 77 through a diode 101. As a result, when the terminals 48 are closed by closing the kill switch 32, the misfiring circuit 77 will be grounded as aforenoted and the engine will be stopped.

In this embodiment, the starter switch 34 is in circuit with the starter solenoid 75 through a second solenoid switch 102 having a winding 103 that is in circuit with the terminals 44 of the kill switch 32 by means of a diode 104 that acts opposite to the diode 101. As a result, when the starter switch 34 is energized and the kill switch 32 is in its normally opened condition, the starter solenoid 75 will be energized so as to close the starter switch 76 and operate the starter motor 31.

If, on the other hand, the kill switch 32 is closed and the starter switch 34 is energized, the solenoid winding 103 will be energized so as to open the switch 102 and prevent energization of the starter solenoid 75. As a result, the engine cannot be restarted when the kill switch is closed and backfiring will be prevented.

It should be readily apparent from the foregoing description that two embodiments of the invention have been illustrated and described, each of which prevent operation of the starter when the kill switch is closed. This will provide a warning to the operator that he should wait some time before he attempts to restart the engine.

Although two embodiments of the invention have been illustrated and described, various changes and modifications may be made without departing from the spirit and scope of the invention, as defined by the appended claims.

I claim:

1. In a control system for a spark ignited magneto fired internal combustion engine having a kill circuit for interrupting the firing of the spark plug when the magneto is generating power and a starter for starting the engine, the improvement comprising means for precluding operation of said starter when said kill circuit is energized.

2. In a control system as set forth in claim 1 wherein the means for operating the kill circuit comprises a kill switch and the means for precluding operation of the starter when the kill circuit is energized comprises a second normally closed switch in the starter circuit that is opened by closure of the kill switch.

3. In a control system as set forth in claim 1 wherein the means for precluding operation of the starter when the kill circuit is energized comprises means for opening the starter circuit when the kill circuit is energized.

4. In a control system as set forth in claim 1 wherein the means for opening the starter circuit when the kill circuit is energized comprises a solenoid switch in the starter circuit that is energized when the kill circuit is closed.

5. In a control system as set forth in claim 1 in combination with a small watercraft powered by the internal combustion engine and having a propulsion unit directly driven the engine.

6. In a control system as set forth in claim 5 further including means for energizing the kill circuit if an operator is displaced from the watercraft.

7. In a control system as set forth in claim 6 wherein the means for operating the kill circuit comprises a kill switch and the means for precluding operation of the starter when the kill circuit is energized comprises a second normally closed switch in the starter circuit that is opened by closure of the kill switch.

8. In a control system as set forth in claim 6 wherein the means for precluding operation of the starter when the kill circuit is energized comprises means for opening the starter circuit when the kill circuit is energized.

9. In a control system as set forth in claim 6 wherein the means for opening the starter circuit when the kill circuit is energized comprises a solenoid switch in the starter circuit that is energized when the kill circuit is closed.

* * * * *

UNITED STATES PATENT AND TRADEMARK OFFICE

CERTIFICATE OF CORRECTION

PATENT NO. : 4,949,684
DATED : August 21, 1990
INVENTOR(S) : Yoshihiro Gohara

It is certified that error appears in the above-identified patent and that said Letters Patent is hereby corrected as shown below:

Claim 2,
Line 2, please change "the means" to -- means --
Line 5, please change "the" to -- a --

Claim 3,
Line 4, please change "the starter" to -- a starter --

Claim 4,
Line 2, please change "the means" to -- means --, and please change "the starter" to -- a starter --

Claim 5,
Line 4, please change "driven the" to -- driven by the --

Claim 7,
Line 2, please change "operating" to -- energizing --
Line 5, please change "the" to -- a --

Claim 9,
Line 2, please change "the means" to -- means --
Line 3, please change "the" to -- a --

Signed and Sealed this

Fourth Day of December, 2001

*Attest:*

Nicholas P. Godici

*Attesting Officer*

NICHOLAS P. GODICI
*Acting Director of the United States Patent and Trademark Office*